US006925666B2

(12) United States Patent
Harrow

(10) Patent No.: US 6,925,666 B2
(45) Date of Patent: Aug. 9, 2005

(54) EASY TO ASSEMBLE BED BASE, TWO-COMPONENT CONNECTOR AND KIT

(76) Inventor: Lawrence Harrow, 5959 Corvette St., Commerce, CA (US) 90040

( * ) Notice: Subject to any disclaimer, the term of this patent is extended or adjusted under 35 U.S.C. 154(b) by 0 days.

(21) Appl. No.: 10/279,280

(22) Filed: Oct. 24, 2002

(65) Prior Publication Data

US 2003/0084509 A1 May 8, 2003

Related U.S. Application Data

(60) Provisional application No. 60/337,414, filed on Nov. 5, 2001.

(51) Int. Cl.[7] ..... A47C 19/00

(52) U.S. Cl. ..... 5/201; 5/282.1; 5/286; 5/299

(58) Field of Search ..... 5/200.1, 201, 203, 5/288, 290, 299, 304, 282.1, 285, 286

(56) References Cited

U.S. PATENT DOCUMENTS

| | | | | |
|---|---|---|---|---|
| 1,566,709 A | * | 12/1925 | Wasserman | 5/299 |
| 1,915,215 A | | 6/1933 | Carpenter | |
| 2,721,338 A | | 10/1955 | Resnick | |
| 3,699,593 A | | 10/1972 | Oetlker | |
| 3,760,437 A | * | 9/1973 | Hooker | 5/201 |
| 4,196,484 A | * | 4/1980 | Harris | 5/201 |
| 4,870,711 A | | 10/1989 | Felix | |
| 5,012,538 A | | 5/1991 | Timm | |
| 5,920,930 A | | 7/1999 | Harrow | |
| 6,415,465 B1 | | 7/2002 | Harrow | |

FOREIGN PATENT DOCUMENTS

DE 3719981 * 12/1988

OTHER PUBLICATIONS

German document 3719981 abstract, Dec. 1988, 1–2 pages.*

New Stronger Three–Tube Bed Base assembly instructions, Apr. 1986.

Snap–Lock assembly instructions, Jun. 1993.

* cited by examiner

*Primary Examiner*—Sunil Singh

(74) *Attorney, Agent, or Firm*—John J. Connors; Connors & Assoc. Inc.

(57) ABSTRACT

A bed base and bed base kit includes four side members, each being symmetrical about its longitudinal axis. The side members are assembled into a rectangular structure with the members positioned to stand vertically upright on their edges. Opposed side members are of the same length and are connected at adjacent ends by a two-component connector. A first component of the connector is attached to the opposed ends of each one of a first pair of opposing side members and a second component is attached to the opposed ends of each one a second pair of opposing side members. The second components are offset from the longitudinal axis of the one side member to which they re attached. Thus, when the side members are assembled to form the rectangular structure, the respective edges of the side members are substantially flush with each other.

11 Claims, 6 Drawing Sheets

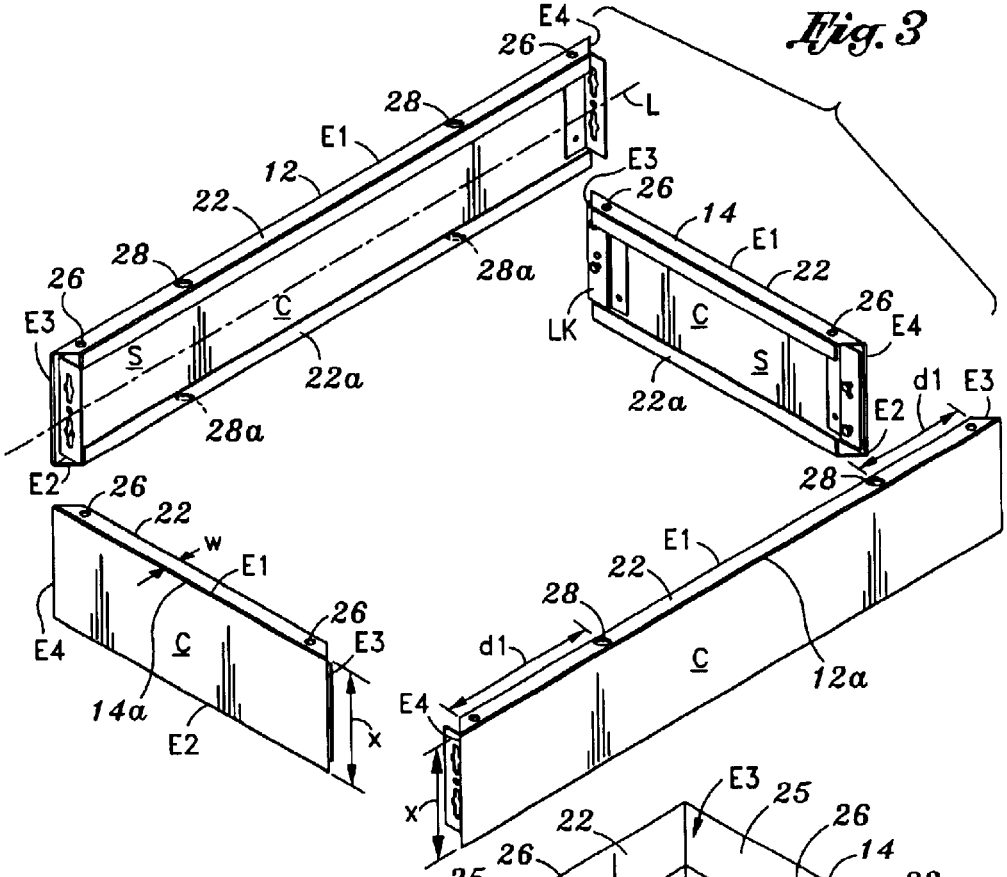
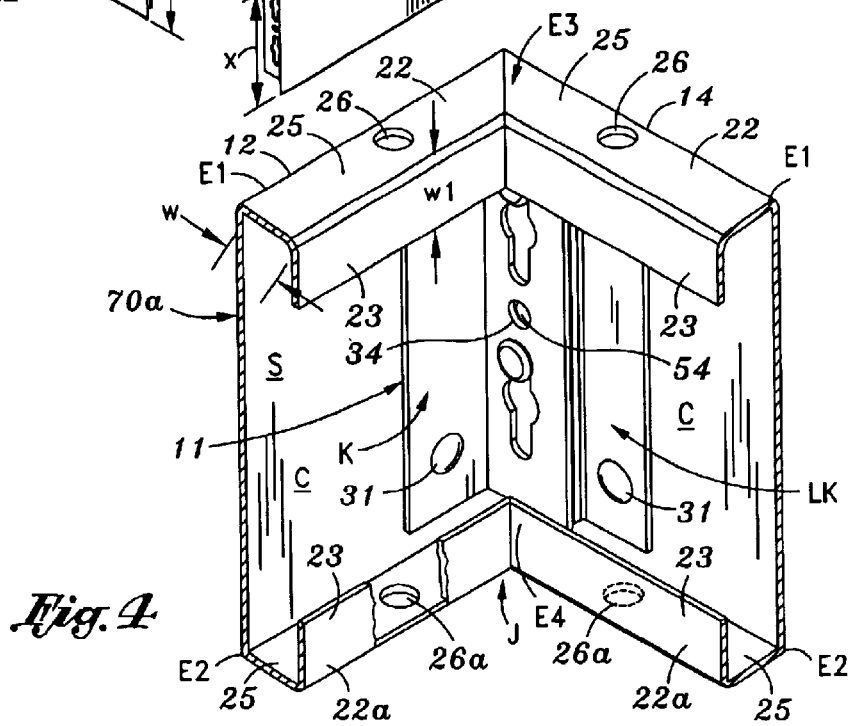
Fig. 4

EASY TO ASSEMBLE BED BASE, TWO-COMPONENT CONNECTOR AND KIT

RELATED PATENT APPLICATION & INCORPORATION BY REFERENCE

This application is a utility application based on U.S. provisional patent application Ser. No. 60/337,414 entitled "Easy To Assemble Bed Base, Two-Component Connector & Kit," filed Nov. 5, 2001. This related application is incorporated herein by reference and made a part of this application. If any conflict arises between the disclosure of the invention in this utility application and that in the related provisional application, the disclosure in this utility application shall govern. Moreover, Applicant incorporates herein by reference any and all U.S. patents, U.S. patent applications, and other documents cited or referred to in this application or cited or referred to in the U.S. patents and U.S. patent applications incorporated herein by reference.

BACKGROUND OF INVENTION

Bed bases are commonly used structures to support above a floor a box-spring and mattress. Typically, they are made up of a number of pieces that are shipped unassembled and then assembled by an installer at the location where the bed base is to be used. In many prior art bed bases the pieces are frequently numerous and sometimes require the use of tools to connect them together. This adds cost to manufacturing, shipping and installing of the bed base. Ideally, a bed base should have a minimum number of pieces, be easy to package and ship, and be conveniently and quickly assembled.

SUMMARY OF INVENTION

This invention, with its several desirable features, is summarized in the CLAIMS that follow. After reading the following section entitled "DETAILED DESCRIPTION," one will understand how the features of this invention provide its benefits. The benefits of this invention include, but are not limited to: (1) lost cost manufacture due to minimizing the number of pieces comprising the bed base, (2) convenience of use and assembly, (3) ease in packaging of the pieces of the bed base into a kit and ease in handling and shipping this kit, and most importantly, (4) the speed at which the pieces may be assembled into the bed base.

The bed base of this invention includes side members, each having opposed edges and opposed ends and each being symmetrical about its individual longitudinal axis. The side members are of equal width and they are positioned to stand vertically upright on one edge. The side members are preferably made from sheet metal that may be bent into a substantially C-shape cross-sectional configuration to form longitudinal, planar support members along the opposed edges of each side member. These support members assist in orienting the side members vertically. The support members are on opposite sides of a central, longitudinal, planar portion of each side member. Preferably, each support member extends outward in the same direction from the planar portion and each support member has substantially the same width and length. One support member is along one of the planar portion edges at substantially a right angle to the planar portion and the other support member is along the other of the planar portion edges at substantially a right angle to the planar portion.

At each opposed end of each side member is one component of a two-component connector. The two-component connector includes a keyhole component and a locking component. Upon assembly of the side members to form the bed base, the locking component on one side member is received in the keyhole component of an adjacent and adjoining side member. Upon connection, the respective edges of the side members are brought into a position relative to each other where their respective edges are substantially flush with each other.

The keyhole component has (a) a first opening with an enlarged central portion and a pair of narrow portions extending outward in opposite directions from the central portion, and (b) a second opening with an enlarged central portion and a pair of narrow portions extending outward in opposite directions from the central portion. The first and second openings are spaced apart a predetermined distance and each openings is equidistant from a central longitudinal axis of the side member to which the keyhole component is attached.

The locking component has first and second outwardly extending finger elements that each have an enlarged head on a narrow neck, the head being sized to pass through a central portion of an opening in a keyhole component but larger than the narrow portions of the opening and the narrow neck being sized to be received in one of the narrow portions. The first and second finger elements are spaced apart a distant equal to the predetermined distance that the openings are spaced apart and offset with respect to a central longitudinal axis of the side member to which the locking component is attached a distance sufficient to bring the opposed edges of a pair of side members together so that the edges of the side members being connected are substantially flush upon assembly of the side members.

One component of the two-component connector may include a catch element and the other component may include a receptacle. Upon manually engaging the two components of the two-component connector, one component moves laterally over a face portion of the other component to attain an interlocking relationship between the catch element and the receptacle, with the catch element seated in the receptacle. Preferably, at least one of the components is made of a malleable material and the catch element is formed in the malleable material. This catch element extends outward from a face portion and is positioned at a predetermined location along the one component to be received in the receptacle of the other component to attain the interlocking relationship.

With a bed base having a substantially rectangular structure, four side members are employed. Optionally, the opposed ends of the side members, in particular the support members, are at an angle of substantially, 45° so that the ends of adjacent and adjoining side members form a miter joint. The connectors at each miter joint holds together the adjoining side members forming the miter joint. The side members of one pair each have first lengths that are equal to each other and the side members of another pair each have second lengths that are equal to each other and longer than the first lengths. All the side members are of equal width. The side members of the same length are opposed to each other. Each side member of one pair having the same length has a keyhole component at both opposed ends thereof. Each side member of the other pair having the same length has a locking component at both opposed ends thereof. The side members are assembled into the rectangular structure with the side members of the one pair being opposed to each other and the side members of the other pair being opposed to each other. This rectangular structure has corners formed by adjoining and adjacent opposed ends of the pairs of side members. These adjoining and adjacent opposed ends are connected together by interlocking the keyhole and locking components of each two-component connector at the corners. The opposed side members of at least one pair of opposed side members are substantially symmetrical and the keyhole component is substantially symmetrical.

Optionally, there is a brace element at each corner of at least one pair of diagonally opposed corners. Preferably, each brace element overlaps adjacent, longitudinal support members of the adjoining, adjacent ends of the side members forming the diagonally opposed corners. The brace elements may include a pair of pin members, one pin member received in a hole in one adjacent, longitudinal support member and the other pin member received in a hole in the other adjacent, longitudinal support member.

It may be desirable for the bed base to include a box-spring/mattress support bar that extends between a pair of opposed side members. Preferably, the support bar has opposed ends with a pin member at or near each end. One pin member is received in a hole in one opposed member of the pair of opposed support members and the other pin member is received in a hole in the other opposed side member of said pair. These holes in the pair of opposed support members are aligned so that the support bar is at a right angle to the support members. Preferably, the support bar has opposed ends and a bracket is mounted to each end of the support bar to move laterally between an extended position and a retracted position. Optionally, each bracket may have a catch element that holds the bracket in the retracted position.

This invention also includes the unique two-component connector used to attach the side members together and a kit wherein the various unassembled pieces of the bed base are placed in a package.

BRIEF DESCRIPTION OF DRAWINGS

The preferred embodiments of this invention, illustrating all its features, will now be discussed in detail. These embodiments depict the novel and non-obvious bed base, connector, and bed base kit of this invention as shown in the accompanying drawings, which are for illustrative purposes only. These drawings include the following figures (Figs.), with like numerals indicating like parts:

FIG. 3 is an exploded view of the bed base side members standing vertically upright on one edge with opposed side members facing each other and positioned to be connected at adjoining, adjacent ends by two-component connectors.

FIG. 4 is an enlarged, fragmentary perspective view, with sections broken away, taken along line 4 of FIG. 2 showing one set of adjoining, adjacent side members connected by one of the two-component connectors shown in FIG. 3.

DETAILED DESCRIPTION

Figure 8:
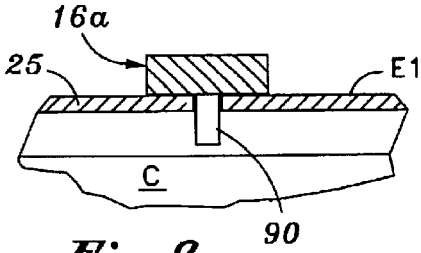
FIG. 8 is a cross-sectional view taken along line 8—8 of FIG. 1.
Figure 9:
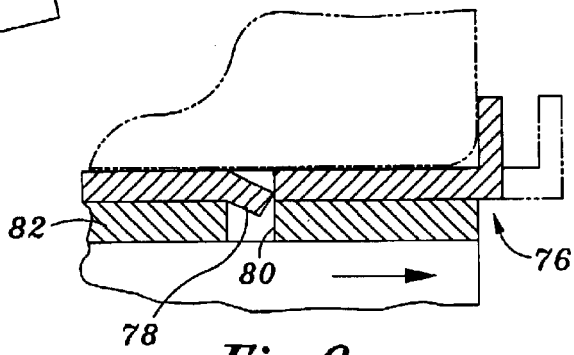
FIG. 9 is a cross-sectional view of a locking device for the brackets at the opposed ends of the box-spring support rails shown in FIG. 1.
Figure 10:
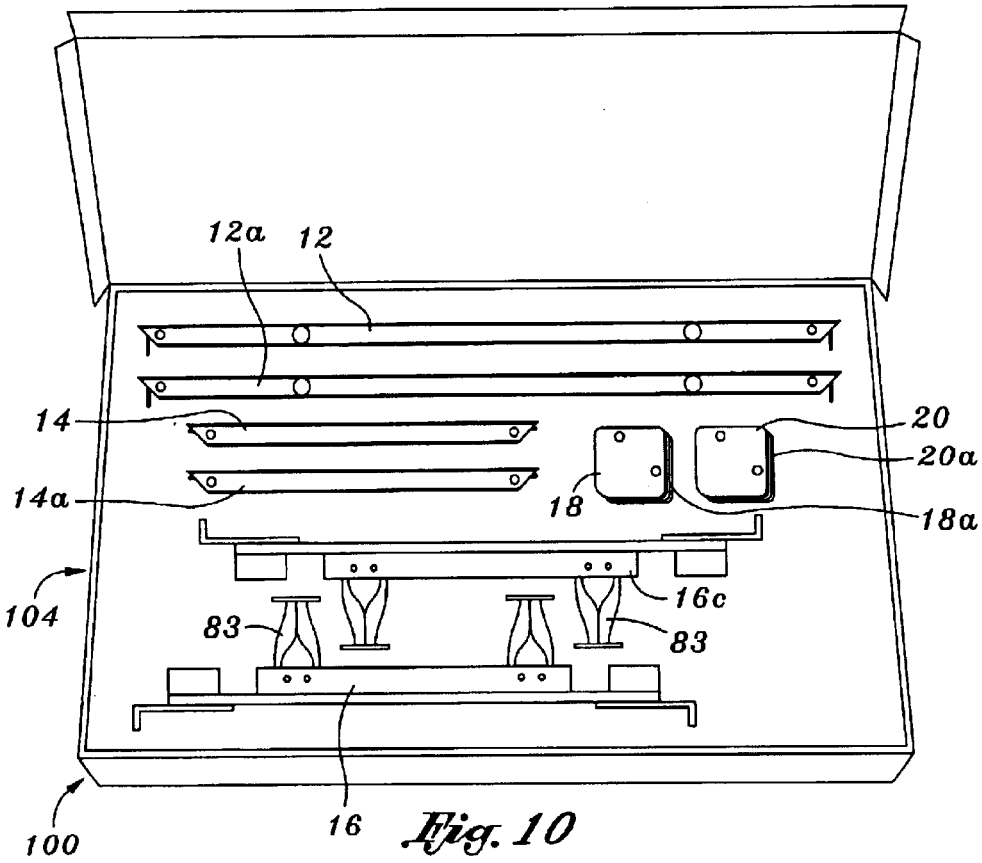
FIG. 10 is a perspective view showing the bed base kit of this invention.

This invention includes both a bed base 10 as illustrated in FIGS. 1 through 9 and a bed base kit 100 as illustrated in FIG. 10. For example, the bed base kit 100 includes all the necessary pieces to assemble, the bed base 10 depicted in FIGS. 1–9. The bed base 10 is sized to support a standard double box-spring 102 (shown in phantom lines). Kits for twin, queen, king and even custom size box-springs and mattresses are also within the scope of this invention. As discussed subsequently in greater detail, the number of pieces in the kits of this invention will vary depending on the size of the box-springs and mattresses being supported by the bed base.

The bed base 10 includes (a) four generally rectangular side members 12, 12*a*, 14, 14*a*, (b) a pair of box-spring/mattress support bars 16, 16*a* extending between, and at right angles to, the pair of opposed side members 12, 12*a*, and (c) four corner brace plates 18, 18*a* and 20, 20*a*. The members 12, 12*a*, 14, and 14*a* are first assembled into a rectangular structure 9 (FIG. 2) with adjoining, adjacent ends E3 and E4 of the side members 12, 12*a*, 14, and 14*a* positioned at right angles to each other to form the rectangular structure's corners 70*a* through 70*b*. A two-component connector 11 shown in detail in FIGS. 5, 6, and 7A and 7B securely connects the adjoining, adjacent ends E3 and E4 at each corner 70*a* through 70*b*.

The individual side members 12, 12*a*, 14, and 14*a* are preferably made from roll formed sheet steel having a thickness of from about 16 to about 20 gauge. The sheet steel is bent into the desired configuration using conventional manufacturing equipment. The opposed side members 12, 12*a* are of the same length of about 71 inches and they do not vary no matter what the size of the box-spring and mattress being supported. Depending on the size of the box-spring and mattress being supported, the opposed side members 14, 14*a* have a length ranging from about 26 to about 63 inches. For any type of box-spring and mattress being supported, the opposed side members 14, 14*a* are of the same length. For example, when a twin size box-spring and mattress is being supported, the length is 26 inches, when a full size box-spring and mattress is being supported, the length is 40 inches, when a king size box-spring and mattress is being supported, the length is 58⅞ inches. All the side members 12, 12*a*, 14, 14*a* are of the same width x ranging from about 5 to about 18 inches. Each individual side member 12, 12*a*, 14, 14*a* is symmetrical about its central longitudinal axis L.

As best shown on FIGS. 3 and 4, each individual side member 12, 12*a*, 14, and 14*a* has a generally C-shaped cross-sectional configuration comprising a central, longitudinally extending, planar portion C with opposed edges E1 and E2. The opposed ends E3 and E4 of each individual side member 12, 12*a*, 14, and 14*a* are cut inward at an angle of substantially 45° to enable the adjoining, adjacent ends E3 and E4 of adjoining, adjacent side members to form a miter joint at each corner 70*a* through 70*b*. Such a miter joint J is depicted in FIG. 4 showing the adjoining, adjacent side members 12 and 14 with their respective adjoining, adjacent ends E3 and E4 abutting each other.

There extends outward in the same direction, respectively from each edge E1 and E2, an L-shaped shoulder support/stiffener 22 and 22*a*. The support/stiffeners 22 and 22*a* face each other, with their feet 23 pointing at each other and their legs 25 oriented horizontally to form longitudinal, planar support platforms. Each longitudinal support platform, or leg 25, has substantially the same width w, typically from about ¾ to about 1¼ inches. The length of each individual leg 25 is the same as the length of the side member from which it extends. Each leg 25 is at a right angle to the planar portion C. The individual feet 23 extend from an outer tip of the leg 25 from which it extends and each has the same width w1, typically from about ¾ to about 1¼ inches. The length of the individual feet is the same as the length of the leg from which it extends. Preferably, for any bad base w and w1 are equal, typically each being I inch.

In the individual side members 12, 12*a*, 14 and 14*a* there are two pairs of these holes 26, 26*a* near opposed end E3 and E4. The individual holes 26 are in the legs 25 that extend from the edge E1 and the individual holes 26*a* are in the legs 25 that extend from the edge E2. The individual holes 26 and 26*a* in each pair of holes are in alignment with each other. In the individual side members 12, 12*a* there are two additional pairs of holes, referred to as intermediate holes 28, 28*a*, spaced apart a distance d, which varies depending on the size of the box-spring and mattress being supported. Each individual pair of intermediate holes 28, 28*a* is set back from its closest end E3 or E4, as the case may be, by an equal distance d1, typically from about 6–12 inches. The individual holes 28 are in the legs 25 that extend from the edge E1 and the individual holes 28*a* are in the legs 25 that extend from the edge E2. The individual holes 28 and 28*a* in each pair of holes are in alignment with each other.

Because the side members 12, 12*a*, 14 and 14*a* are so designed as discussed above, the two halves of each individual side member partitioned along its longitudinal axis L are mirror images, making each side member symmetrical about its longitudinal axis. Each individual side member 12, 12*a*, 14 and 14*a* is also symmetrical about a central axis ZZ passing through the center of each side member and at a right angle to the individual member's longitudinal axis L. This feature of structural symmetry of the side members 12, 12*a*, 14 and 14*a* is important for quick and easy assembly of the bed base of this invention, as will be better understood upon reading the section entitled "Bed Base Assembly."

Figure 5:
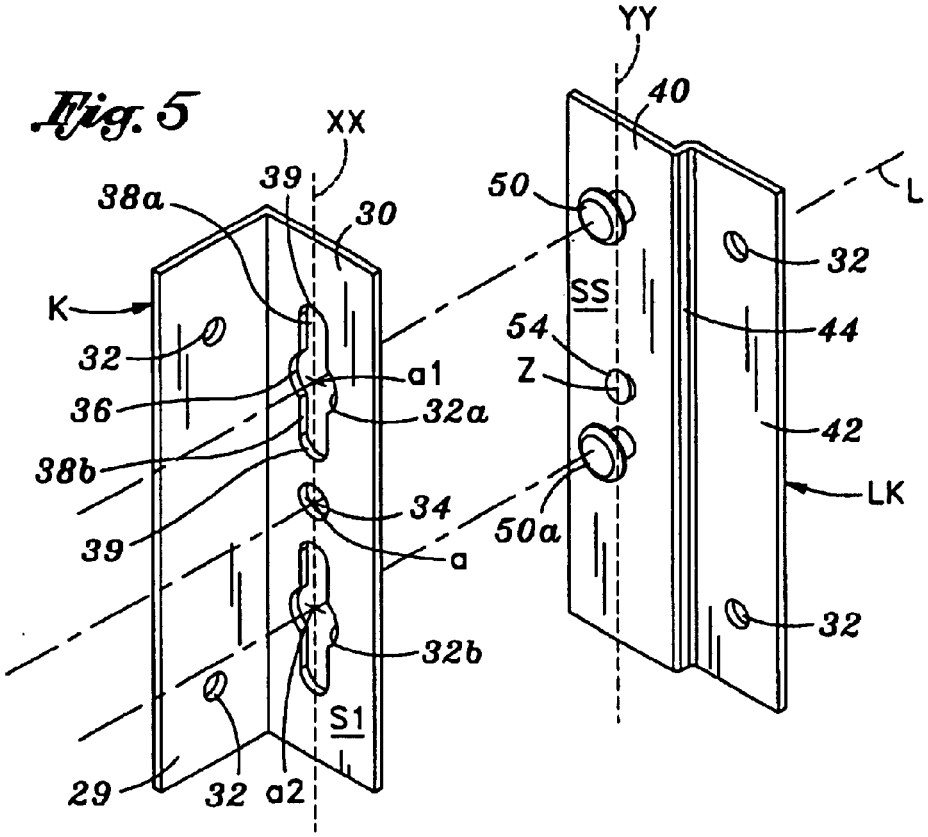
FIG. 5 is a perspective view of each component of the two-component connector shown in FIG. 4 prior to being attached to a side member and prior to being connected to each other.
Figure 6:
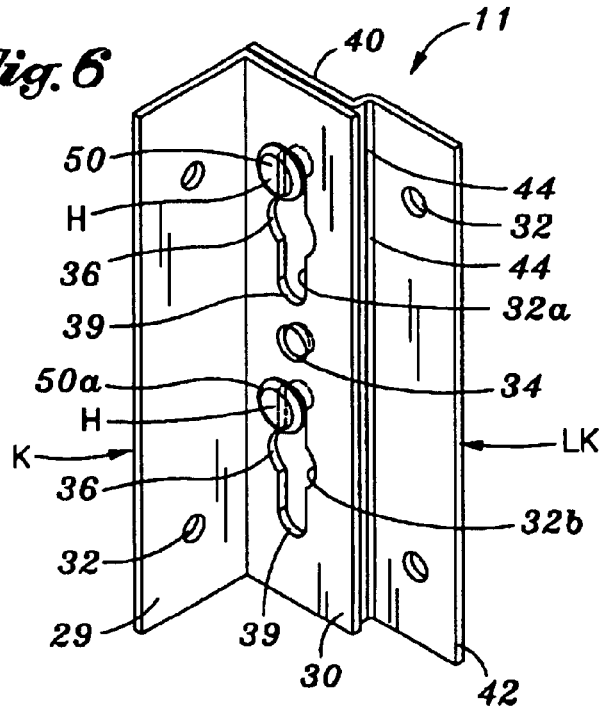
FIG. 6 is a perspective view showing the components of the two-component connector shown in FIG. 4 connected to each other.

As best shown in FIGS. 5 and 6, the two-component connector 11 with each component made from steel sheet. The two-component connector 11 includes (a) a keyhole component K, one attached, respectively, to each of the opposed ends E3 and E4 of the members 12 and 12*a*, and (b) a locking component LK, one attached, respectively, to each of the opposed ends E3 and E4 of the members 14 and 14*a*. These components K and LK are fastened securely by rivets 31 to the planar portions C of the side members 12, 12*a*, 14, and 14*a*. The rivets 31 pass through holes 32 in these components K and LK. These components K and LK are all attached to the inside surfaces S of the planar portions C of the side members 12, 12*a*, 14, and 14*a*, so that they all face inwardly upon assembly of these side members to form the bed base 10.

The keyhole component K has a generally L-shape configuration and in one leg 29 are the holes 32 for the rivets 31 and in another leg 30 are two identically, symmetrically shaped oblong-type openings 32*a* and 32*b* aligned along an axis XX of this leg 30. There is a centrally located hole 34 with its center coincident with the center a of the leg 30 and the longitudinal axis L intersecting this center a at a right angle to the leg 30. This hole 34 serves as a receptacle for a catch element 54 on the locking component LK. The centers a1 and a2 respectively of the openings 32*a* and 32*b* are equidistant from the longitudinal axis L of the side members to which each keyhole component K is attached. Each opening 32*a* and 32*b* has an enlarged central, circular portion 36 and a pair of narrow rectangular portions 38*a* and 38*b*, each with rounded outer terminal ends 39. These narrow portions 38*a* and 38*b* extend outward in opposite directions from the central portion 36 at equal distances from the center of the circular portion 36, centers a1 or a1 as the case may be. They lie along a common line which is substantially at a right angle to the longitudinal axis L. Thus, each opening 32*a* and 32*b* is symmetrical about its respective center a1 or a1 as the case may be, and these openings 32*a* and 32*b*, being positioned equidistant from the longitudinal axis L and aligned along the axis XX, make the leg 30 symmetrical.

The locking component LK has two plates 40 and 42 connected by a narrow section 44. The holes 32 for the rivets 31 are in the plate 42 and a pair of fingers 50 and 50*a* extend outwardly from the inside surface SS of the plate 40. The locking component LK, preferably being made of a malleable material such as steel sheet, has the catch element 54 formed in this malleable material by partially punching the steel sheet. The catch element 54 extends outward from the inside surface SS of the plate 40. Each finger 50 and 50*a* has an enlarged head H mounted on an end of a narrow neck N. The neck N is sufficiently long to facilitate interconnecting the keyhole component K and the locking component LK by allowing the neck N to slide along the either portion 38*a* or 38*b* while the head rides on the surface S1 of the leg 30 of the keyhole component K. Each head H is sized to pass through the central portion 36 of the symmetrically shaped openings 32*a* and 32*b* in the keyhole component K but are larger than the narrow portions 38*a* and 38*b*. The narrow neck N is sized to be received in the one of narrow portion 38*a* or 38*b* upon assembly of the bed base 10.

The fingers 50 and 50*a* are aligned along the longitudinal axis YY of the plate 40 and the catch element 54 is along this axis YY between the fingers, closest to the finger 50*a*. The longitudinal axis YY is substantially at a right angle to the longitudinal axis L. The catch element 54 is positioned at a predetermined location along the axis YY to be received in the hole 34 of the keyhole component K to attain an interlocking relationship upon connecting the two components K and LK of the two-component connector 11. Each locking component LK is attached to the central portion C of a side member 14 or 14*a*, as the case may be, so that the center Z of the catch element 54 is along the central longitudinal axis L of the side member to which it is attached. This positions the center of the head H of the finger 50 a distant of d3 from the edge E1 and the center of the head H of the finger 50*a* a distant of d4 from the edge E2. The distance d4 is greater than the distance d3. The distant between the centers of the heads H of the fingers 50 and 50*a* is equal to the distant d5 between the centers a1 and a2 of the symmetrically shaped openings 32*a* and 32*b* in the keyhole component K.

Figure 7A:
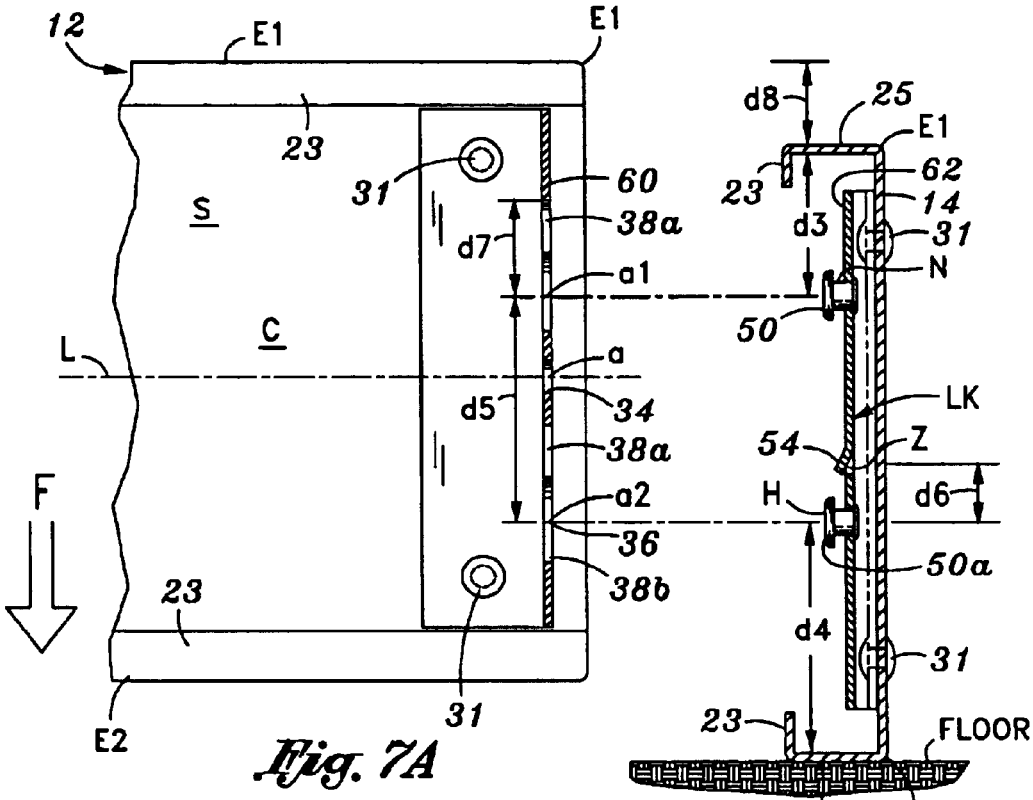
FIG. 7A is a partial cross-sectional view showing adjacent side members positioned apart from each other and aligned so that the individual components of the two-component connector at adjacent ends of these side members are aligned for connection with each other.

It is important that each locking component LK of each pair of locking components mounted to a side member 14 and 14*a* be positioned correctly on the side member to which it is attached to properly interconnect with its counterpart keyhole component. As shown in FIG. 7A, the position of each pair of components LK is such that, when the heads H of the fingers 50 and 50*a* are aligned, respectively, with the centers a1 and a2 of the openings 38*a* and 38*b* in the keyhole component K, the top edge E1 of the side member 14 is below the top edge E1 of the side member 12 a distance d8. This distance d8 is equal to the distance d7 between each center a1 and a2 and each of the rounded ends 39 of the portions 38*a* and 38*b* of the openings 32*a* and 32*b*. The distance d6 between the head H of the finger 50*a* and the center Z of the catch element 54 is equal to the distance d7 and the distance d8. Consequently, the installer can only move the two side members 12 and 14 this distance d8 only in one direction to lock the side members together. Specifically, the installer moves the side members 12 and 14 relative to each other to bring the catch element 54 of the locking component LK into locking engagement with the hole 34 in the keyhole component K to connect securely the adjoining, adjacent side members 12 and 14. This simplifies the assembly of the bed base 10, enabling the installer to assemble more rapidly all the side members 12, 12*a*, 14, and 14*a* into the rectangular structure 9.

Figure 1:
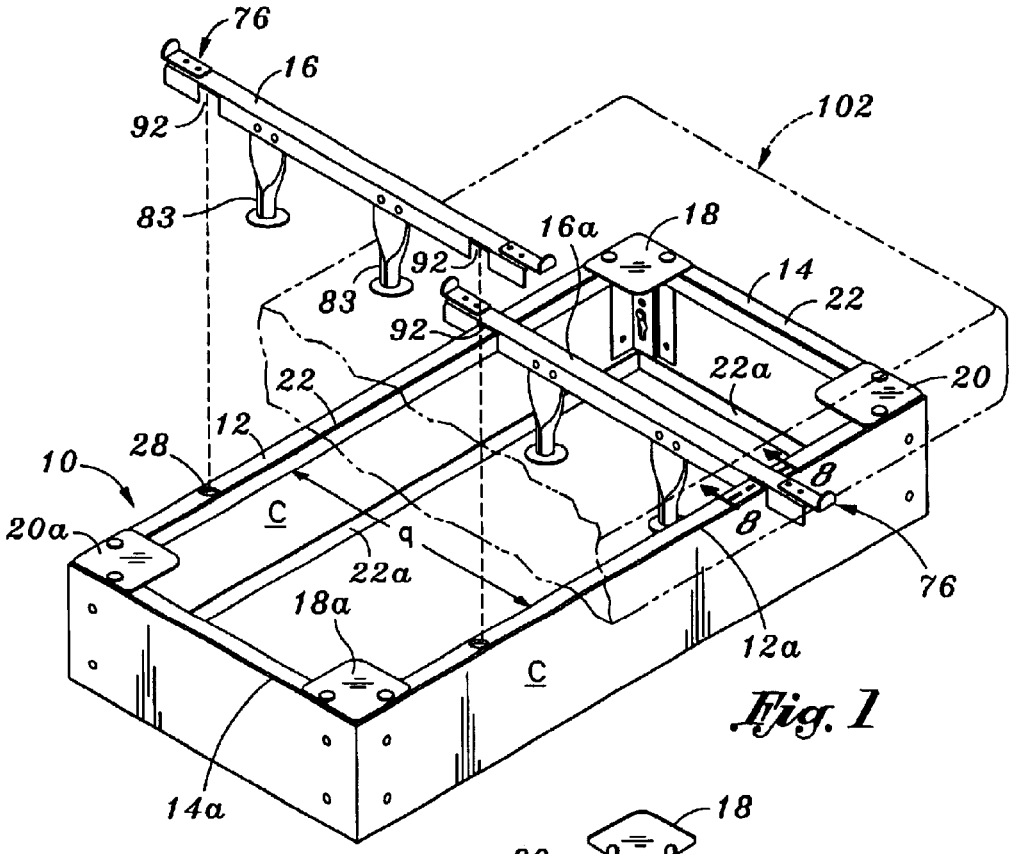
FIG. 1 is a partially exploded perspective view of the assembled bed base of this invention.
Figure 2:
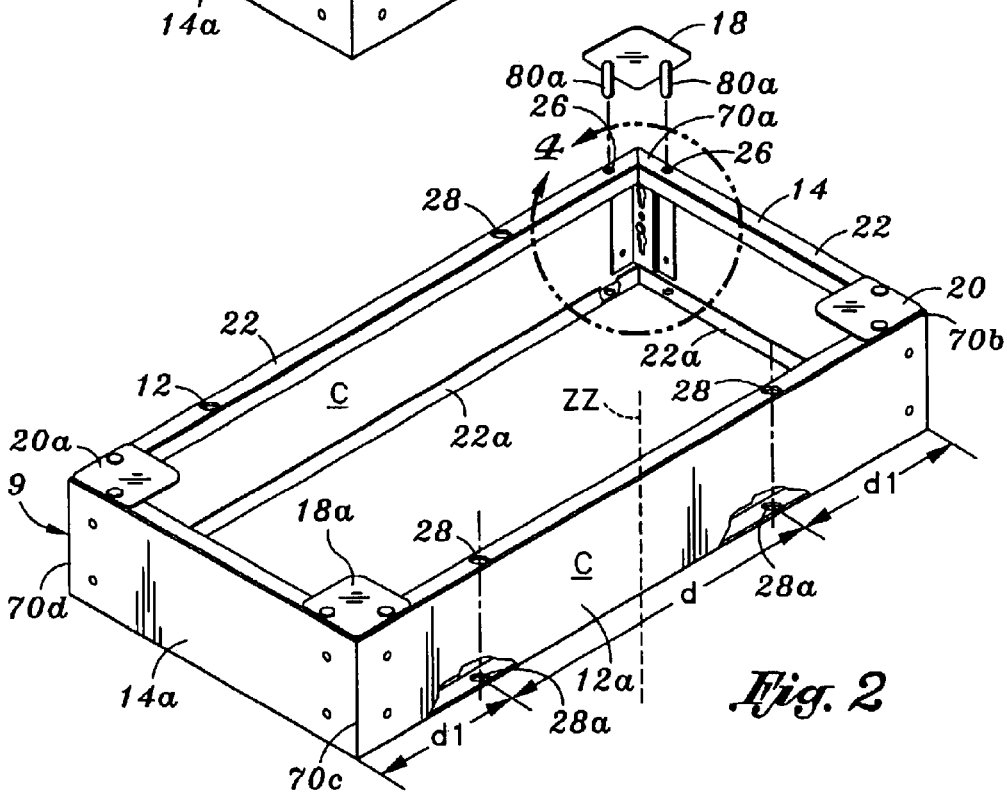
FIG. 2 is a partially assembled bed base of this invention, with sections broken away.

As best shown in FIGS. 1 and 9, each support bar 16 and 16*a* has an L-shaped arm 82 that has at each opposed ends thereof a bracket 76 mounted thereto to move laterally between an extended position shown in dotted lines in FIG. 9 and a retracted position shown in solid lines in FIG. 9. There is a catch element 78, similar to the catch element 54, that holds the bracket 76 in the retracted position by locking engagement with a hole 80 in the arm 82 to which the bracket is attached, in this case the opposed ends of the support bar 16*a*. The details of this bracket are discussed in U.S. Pat. No. 5,920,930. Inward from each opposed end of the support bars 16 and 16*a* is a cutaway section 92. The cut-away sections 92 on each support bar 16 and 16*a* are spaced apart from each other by a distance equal to the distance q between the opposed feet 23 of the side members 12 and 12*a*. Each cut-away section 92 has a width that is about equal to the width w of the legs 25. A pair of stands 83 extend at right angles downward from intermediate locations along the arm 82 between the cut-away sections 92. More than two stands 83 may be used when larger bed bases are provided in the case of queen and king sizes.

As shown in FIG. 8, near each opposed end of each support bar 16 and 16*a* is a downward projecting pin 90. Each one of these pins 90 at the opposed ends of the supports bar 16 and 16*a* is positioned between the bracket 76 at an adjacent opposed end and the adjacent cut-away section 92. As illustrated in FIG. 1, when the support bars 16 and 16*a* are placed at right angles to the side members 12 and 12*a* on top of the opposed edges E1, the cut-away sections 92 in each support bar 16 and 16*a* fit snugly over these opposed edges. As depicted in FIG. 8, the pins 90 on each support bar 16 and 16*a* are aligned to pass through the intermediate holes in the legs 25 of the opposed side member 12 and 12*a*, in this case the opposed aligned holes 28. If the side members 12 and 12*a* where inverted, the pins 90 would pass through the aligned intermediate holes 28*a*.

Bed Base Assembly

The installer assembles the four side members 12, 12*a*, 14, 14*a* by standing them vertically upright on their edges E2 and connecting together the keyhole component K and locking component LK of the two-component connectors 11 at adjoining, adjacent ends E1 and E2 of adjoining, adjacent side members. For example, to interlock the two components K and LK of the connector 11 at the adjoining, adjacent ends E3 and E4 of the side members 12 and 14, the installer first aligns the fingers 50 and 50*a*, respectively, with the enlarged central, circular portions 36 of the openings 32*a* and 32*b* as shown in FIG. 7A. Next, the installer moves the two components K and LK into engagement with each other, passing the heads H of the fingers 50 and 50*a* through the openings 32*a* and 32*b* in the keyhole components K. The fingers 50 and 50*a* pass through the openings 32*a* and 32*b* and a backside face 60 of the keyhole component K is pushed against a front side face 62 of locking component LK.

Figure 7B:
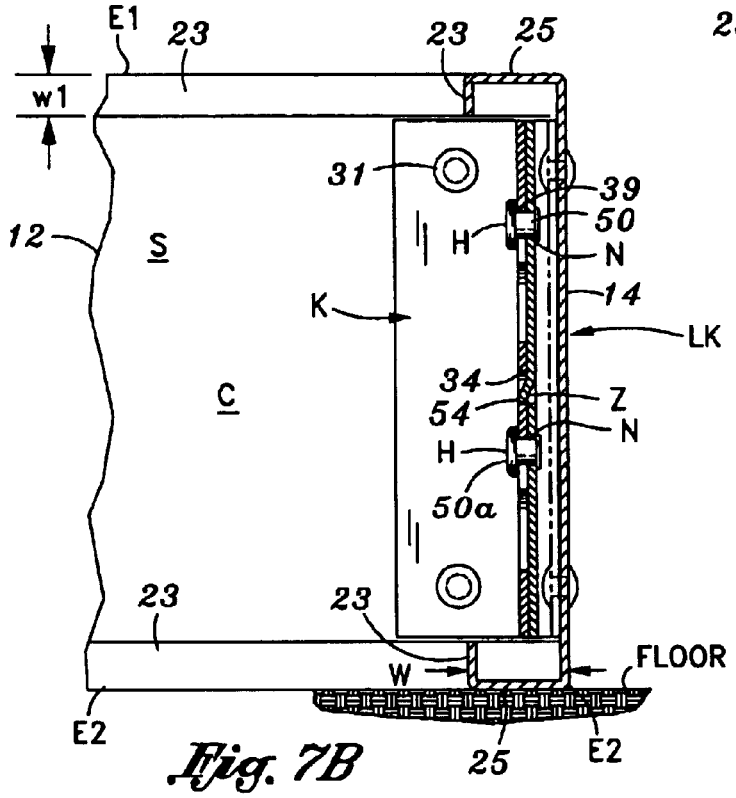
FIG. 7B is a partial cross-sectional view like that of FIG. 7A showing the individual components of the two-component connector connected to each other.

With the fingers 50 and 50*a* extending through openings 32*a* and 32*b*, the installer pushes the side member 12 downward in the direction indicated by the arrow F while the edge E2 of the side member 14 rests against a floor. This moves the locking component LK laterally over the backside face 60 of the keyhole component K to press the necks N of the fingers 50 and 50*a* respectively against the rounded outer ends 39 of the rectangular portions 38*a* and 38*b* of the opening 32*a* and 32*b*. As shown in FIG. 7B, the heads H are external to the rectangular portions 38*a* and 38*b* and the catch element 54 snaps into locking engagement with the hole 34 to lock the components K and LK together. Thus, when adjoining side members 12, 12*a*, 14, and 14*a* are assembled to form the rectangular structure, the respective edges E1 and E2 are flush with each other as shown in FIG. 7B. Because of the symmetry of the side members 12 and 12*a*, the installer never needs to be concerned whether or not these members are in inverted, because of they have identical mirror halves. The side members 14 and 14*a* are always positioned by the installer in the same manner with the finger 50*a*, the finger nearest the edge E2 closest to the floor. The installer, however, place the side members 12 and 12*a* on the floor and then attach the side members 14 and 14*a*.

Connecting the two-component connectors 11 at each corner 70*a* through 70*d* forms the rectangular structure 9. When the installer has assembled the rectangular structure 9, the brace plates 18 and 18*a* are attached at each diagonally opposed corners 70*a* and 70*c* and the brace plates 20, 20*a* are attached at diagonally opposed corners 70*b* and 70*d*. As illustrated in FIG. 1, each brace plate 18, 18*a*, 20, and 20*a* have a pair pins 80, 80*a*. The brace plate at each corner 70*a* through 70*b* overlaps and is mounted to adjoining, adjacent side members, with one pin of each pair extending through the holes 26 in the legs 25 at adjacent ends of adjoining, adjacent side members. For example, the one pin 80 is received in the hole 26 in the leg 25 of the support/stiffener 22 of the side member 12 and the other pin 80*a* on this same brace plate 18 is received in the hole 26 in the leg 25 of the support/stiffener 22 of the side member 14.

The installer places the box-spring/mattress support bars 16 and 16*a* on top of the rectangular structure 9 to extend between the opposed side member 12 and 12*a* as shown in FIG. 1. As discussed above, one pin 90 at one opposed end of a support bar is received in the hole 28 in one leg 25 of the side member 12 and the other pin 90 is received in the hole 28 in the one leg 25 of the opposed side member 12*a*. The holes in the legs 25 of the opposed side members 12 and 12*a* are aligned so that the support bars 16 and 16*a* are each at a right angle to these opposed side members.

Bed Base Kit

The bed base kit 100 includes a package 104 containing all the pieces to assemble the bed base 10: namely, the four side members 12, 12*a*, 14, and 14*a*, the four corner brace plate 18, 18*a*, 20, and 20*a*, and the two box-spring/mattress support bars 16 and 16*a*. The package may be substantially smaller that that depicted, requiring the individual pieces to be stacked on top of each other. A smaller package would be more convenient to ship. Each component K and LK of the two-component connectors 11 are attached to the side members 12, 12*a*, 14, and 14*a*, with each side member having the same type of component at each opposed end and each pair of side members having the same length employing identical components. Specifically, the side members 12 and 12*a* have the keyhole component K at each opposed end E3 and E4 and the side members 14 and 14*a* have the locking component LK at each opposed end E3 and E4.

When a twin size bed base is provided, fewer pieces are needed than the kit 100 depicted in FIG. 10. In the case of a twin size bed base, a kit includes four side members, only one pair of corner brace plates, and only one box-spring/mattress support bar. The dimensions of the side members and the box-spring/mattress support bar would be appropriate for supporting the twin size box-spring. The corner brace plates would be attached to diagonal corners.

Alternate Brace Plate

Figure 11:
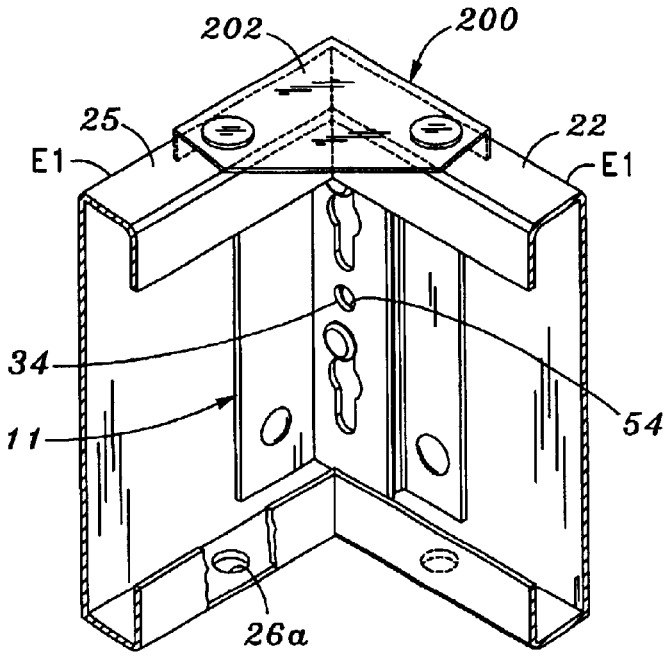
FIG. 11 is a perspective view of an alternate shaped brace plate used in this invention, showing the plate attached to a corner.
Figure 12:
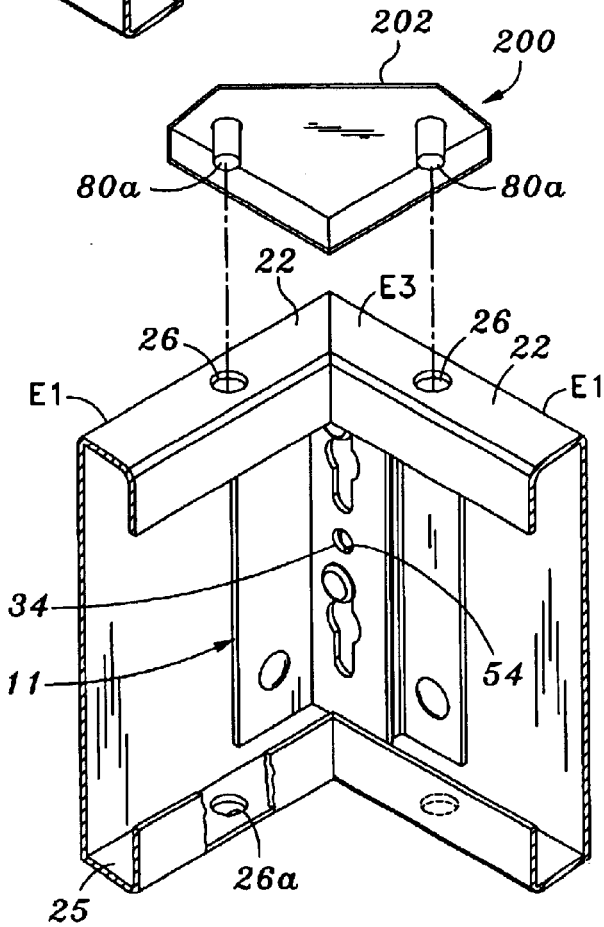
FIG. 12 is a perspective view illustrating the alternate shaped brace plate of FIG. 11 tilted to show its underside.

An alternate form of a brace plate, designated by the numeral 200, as shown FIG. 11, employs a plate 202 with a triangular shape. The pair pins 80*a* extend from the underside of the plate 202 and are positioned to be received in the holes 26 near the corners of the assembled side members as discussed above.

Scope of the Invention

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

What is claimed is:

1. A bed base including four side members assembled into a substantially rectangular structure, each side member having a central longitudinal axis, opposed ends, and substantially the same width, said individual side members each being symmetrical about its individual longitudinal axis, and a first pair of side members having first lengths that are equal to each other and a second pair of side members having second lengths that are equal to each other and longer than said first lengths, said side members of equal lengths being opposed to each other, each side member having a central, longitudinal, planar portion with opposed edges and a pair of longitudinal, planar support members extending outward in the same direction, each longitudinal support member having substantially the same width and substantially the same length, one support member being along one of said edges at substantially a right angle to the planar portion and the other support member being along the other of said edges at substantially a right angle to the planar portion, the first pair of side members positioned opposite each other and the second pair of side members positioned opposite each other, one opposed end of one side member of the first pair being adjacent to one opposed end of the other side member of the second pair, and connectors that connect adjoining, adjacent ends of the side members, each connector has a first component at one opposed end of one side member and a second component at one opposed end of an adjacent side member, where the first component is a keyhole component and the second component is a locking component, said keyhole component having a first opening with an enlarged central portion and a pair of narrow portions extending outward in opposite directions from the central portion, and a second opening with an enlarged central portion and a pair of narrow portions extending outward in opposite directions from the central portion, said first and second openings being spaced apart a predetermined distance and each said openings being equidistant from the central longitudinal axis of the side member to which the keyhole component is attached, and said locking component having first and second outwardly extending finger elements that each have an enlarged head on a narrow neck, said head sized to pass through a central portion of an opening in a keyhole component but larger than the narrow portions of said opening and said narrow neck being sized to be received in one of the narrow portions, said first and second finger elements being spaced apart a distant equal to the predetermined distance that said openings are spaced apart and offset with respect to the central longitudinal axis of the side member to which the locking component is attached at distance sufficient to bring the opposed edges of the side members together so that said edges are substantially flush upon assembly of the side members to form the rectangular structure.

2. The bed base according to claim 1 where the substantially rectangular structure has four corners and there is at least one corner brace element overlapping and mounted to adjacent, longitudinal support members of said adjacent ends of the side members.

3. The bed base according to claim 2 where each brace element includes a pair of pin members, one pin member received in a hole in one adjacent support member and the other pin member received in a hole in an adjacent support member.

4. A bed base kit including four substantially rectangular side members, each side member having a longitudinal axis, opposed ends, and the same width, and one component of a two-component connector at each opposed end of the side members, said individual side members each being symmetrical about its individual longitudinal axis, and a first pair of side members having first lengths that are equal to each other and a second pair of side members having second lengths that are equal to each other and longer than said first lengths, each side member having a central, longitudinal, planar portion with opposed edges and a pair of longitudinal, planar support members extending outward in the same direction, each longitudinal support member having substantially the same width and length and one support member along one of said edges at substantially a right angle to the planar portion and the other support member along the other of said edges at substantially a right angle to the planar portion, and at least one a box-spring/mattress support bar, where the two-component connector has a first component at one opposed end of one side member and a second component at one opposed end of another side member, the first component having a first opening with an enlarged central portion and a pair of narrow portions extending outward in opposite directions from the central portion, and a second opening with an enlarged central portion and a pair of narrow portions extending outward in opposite directions from the central portion, said first and second openings being spaced apart a predetermined distance and each said openings being equidistant from the central longitudinal axis of the side member to which the keyhole component is attached, and said second component having first and second outwardly extending finger elements that each have an enlarged head on a narrow neck, said head sized to pass through a central portion of an opening in a keyhole component but larger than the narrow portions of said opening and said narrow neck being sized to be received in one of the narrow portions, said first and second finger elements being spaced apart a distant equal to the predetermined distance that said openings are spaced apart and offset with respect to the central longitudinal axis of the side member to which the locking component is attached at distance sufficient to bring the opposed edges of the side members together so that said edges are substantially flush upon assembly of the side members to form the rectangular structure.

5. The bed base kit according to claim 4 one component has a catch element and the other component has a receptacle, and upon manually engaging the first and second components, one component moves laterally over a face portion of the other component into an interlocking relationship and the catch element is seated in the receptacle.

6. The bed base kit according to claim 5 where at least one of the components is made of a malleable material and the catch element is formed in the malleable material and extends outward therefrom and is positioned at a predetermined location along said one component to be received in the receptacle of the other component to attain said interlocking relationship.

7. The bed base kit according to claim 4 where the opposed ends of each side member are at an angle of substantially 45°, so that, upon assembly of the side members into a rectangular structure, the ends of adjoining side members form a miter joint.

8. The bed base kit according to claim 4 including at least two brace elements, so that, upon assembly of the side members into a rectangular structure having four corners, one individual brace element is mounted to and extends across adjoining side members forming a first corner and the other individual brace element is mounted to and extends across adjoining side members forming a second corner that is diagonal to the first corner.

9. A bed base including side members assembled into a substantially rectangular structure with the side members positioned to stand substantially vertically upright on their edges and connected at each pair of adjacent ends by a two-component connector, said two-component connector including a first component having a pair openings, each opening having a center equidistant from the longitudinal axis of the side member to which each said first component is attached, and each said opening having an enlarged central portion and a pair of narrow portions, said narrow portions extending outward in opposite directions from the central portion at equal distances from the center of the opening, a second component having a pair of outwardly extending finger elements, each finger element having an enlarged head on a narrow neck, each said head sized to pass through the central portion of one opening in the first component but larger than the narrow portions and each said narrow neck being sized to be received in one of the narrow portions, said second components attached to one side member at an offset positioned from the longitudinal axis of said one side member, so that, when the adjoining side members are assembled to form the substantially rectangular structure, the respective edges of the side members are substantially flush with each other, where the side members have a substantially C-shape cross-sectional configuration.

10. The bed base according to claim 9 where the opposed ends of each side member are at an angle of substantially 45°, so that, upon assembly of the side members into a rectangular structure, the ends of adjoining side members form a miter joint.

11. A bed base including side members assembled into a substantially rectangular structure that has substantially right angle corners formed by connecting adjacent side members, each side member having (a) opposed ends, (b) substantially the same width, (c) a central longitudinal axis and substantially symmetrical about its individual longitudinal axis, (d) a central, longitudinal, planar portion having an inside surface and a pair of opposed edges, (e) a pair of longitudinal, planar support members, one planar support member extending lengthwise along one of said edges and at substantially a right angle to the planar portion and the other support member extending lengthwise along the other of said edges and at substantially a right angle to the planar portion, each planar support member projecting inward with respect to its inside surface and the central, longitudinal, planar portion of each side member being oriented substantially vertically, and a two-component connector at each corner that connects adjacent ends of the side members, each two-component connector comprising a keyhole component at one opposed end of one side member that is attached to the inside surface of the planar portion of said one side member and a locking component at one opposed end of an adjacent side member that is attached to the inside surface of the planar portion of said adjacent side member, said keyhole component having a first opening with an enlarged central portion and a pair of narrow portions extending outward in opposite directions from the central portion, and a second opening with an enlarged central portion and a pair of narrow portions extending outward in opposite directions from the central portion, said first and second openings being spaced apart a predetermined distance and each said openings being equidistant from the central longitudinal axis of the side member to which the keyhole component is attached, and said locking component having first and second outwardly extending finger elements that each have an enlarged head on a narrow neck, said head sized to pass through a central portion of an opening in a keyhole component but larger than the narrow portions of said opening and said narrow neck being sized to be received in one of the narrow portions, said first and second finger elements being spaced apart a distant equal to the predetermined distance that said openings are spaced apart and offset with respect to the central longitudinal axis of the side member to which the locking component is attached at distance sufficient to bring the opposed edges of the side members together so that said edges are substantially flush upon assembly of the side members to form the rectangular structure.

* * * * *